US012704029B2

(12) United States Patent
Bjerke et al.

(10) Patent No.: US 12,704,029 B2
(45) Date of Patent: Aug. 11, 2026

(54) JACK FOR DRILLING

(71) Applicant: Petro Well Services AS, Ålesund (NO)

(72) Inventors: Bjørn Bjerke, Ålesund (NO); Vivian Larsgård-Ingebrigtsen, Ålesund (NO); Lars Martin Godø, Larsnes (NO)

(73) Assignee: PETRO WELL SERVICES AS, Alesund (NO)

( * ) Notice: Subject to any disclaimer, the term of this patent is extended or adjusted under 35 U.S.C. 154(b) by 0 days.

(21) Appl. No.: 18/880,812

(22) PCT Filed: Jun. 30, 2023

(86) PCT No.: PCT/NO2023/060007
§ 371 (c)(1),
(2) Date: Jan. 2, 2025

(87) PCT Pub. No.: WO2024/010457
PCT Pub. Date: Jan. 11, 2024

(65) Prior Publication Data

US 2025/0314138 A1 Oct. 9, 2025

(30) Foreign Application Priority Data

Jul. 7, 2022 (NO) ..... 20220782

(51) Int. Cl.
*E21B 19/083* (2006.01)

(52) U.S. Cl.
CPC ..... *E21B 19/083* (2013.01)

(58) Field of Classification Search
CPC ..... E21B 19/083; E21B 19/086
See application file for complete search history.

(56) References Cited

U.S. PATENT DOCUMENTS 1,033,990 A * 7/1912 Connoly ..... E21B 19/083 175/161
4,421,175 A * 12/1983 Boyadjieff ..... E21B 15/00 166/383
4,437,515 A * 3/1984 Boyadjieff ..... E21B 19/07 166/77.52

(Continued)

FOREIGN PATENT DOCUMENTS

EP 1076790 2/2001
EP 3548414 10/2019

(Continued)

OTHER PUBLICATIONS

Norwegian Search Report in corresponding Norwegian Application No. 20220782 dated Nov. 3, 2022. (2 pages).

(Continued)

*Primary Examiner* — Kipp C Wallace
(74) *Attorney, Agent, or Firm* — Wissing Miller LLP

(57) ABSTRACT

The present invention concerns a jack (1) for drilling, the jack comprising an elongated receiving element (3A) for receiving and clamping a tubular element and a base (2) comprising an open-ended aperture, the elongated receiving element (3A) being arranged in the open-ended aperture. The elongated receiving element (3A) is linearly moveable through the open-ended aperture between a retracted position and an extended position. The invention further concerns a drill rig, the use of a jack for drilling and a method for handling a pipe section of a drill string.

15 Claims, 4 Drawing Sheets

1

(56) References Cited

U.S. PATENT DOCUMENTS

Figure 1A:
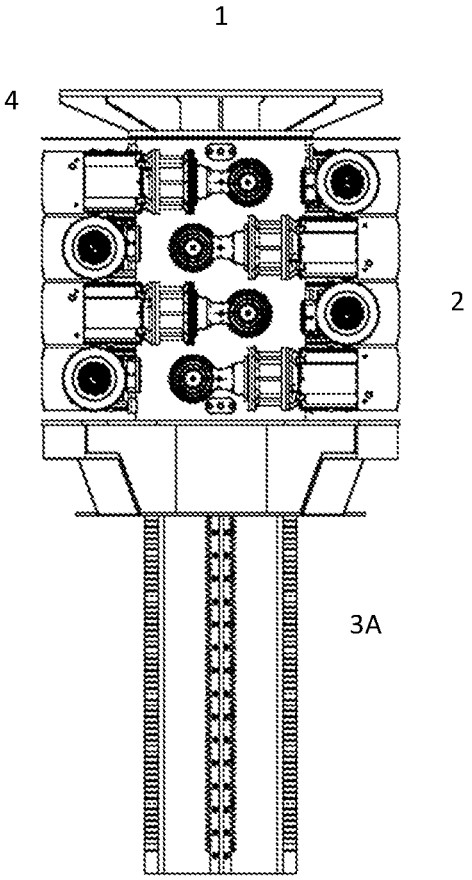

| | | | | |
|---|---|---|---|---|
| 6,412,560 | B1 * | 7/2002 | Bernat | E21B 19/07 166/383 |
| 10,036,215 | B2 | 7/2018 | Wood | |
| 10,107,079 | B1 * | 10/2018 | Frey | F16C 17/06 |
| 12,442,251 | B1 * | 10/2025 | Herrick | E21B 7/046 |
| 2007/0261860 | A1 * | 11/2007 | Hallonquist | E21B 19/086 166/381 |
| 2013/0341036 | A1 | 12/2013 | Flusche | |
| 2015/0349603 | A1 * | 12/2015 | Parmeter | F04D 29/048 310/90 |
| 2016/0161023 | A1 | 6/2016 | Wentworth et al. | |
| 2018/0080291 | A1 * | 3/2018 | Sipos | E21B 19/083 |

FOREIGN PATENT DOCUMENTS

| | | | | |
|---|---|---|---|---|
| NO | 159192 | | 8/1988 | |
| WO | 9848142 | | 10/1998 | |
| WO | 0022277 | | 4/2000 | |
| WO | 02079602 | | 10/2002 | |
| WO | 2014066368 | | 5/2014 | |
| WO | 2018106711 | | 6/2018 | |
| WO | WO-2021107771 | A1 * | 6/2021 | E21B 7/124 |

OTHER PUBLICATIONS

International Search Report and Written Opinion in corresponding PCT Application No. PCT/NO2023/060007 dated Oct. 19, 2023. (11 pages).

International Preliminary Report on Patentability in corresponding PCT Application No. PCT/NO2023/060007 dated Nov. 24, 2024. (7 pages).

* cited by examiner

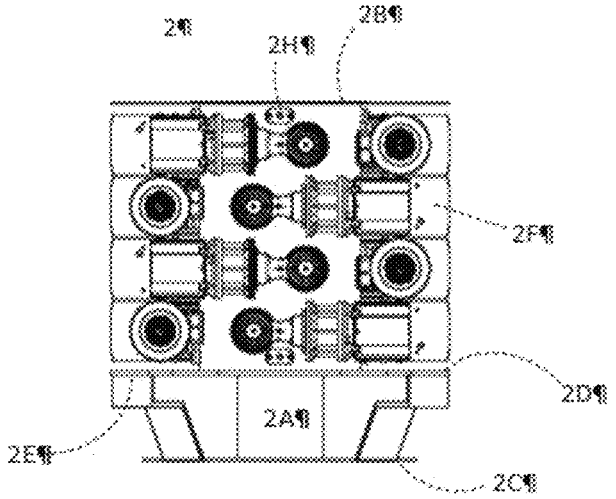
Figure 2A¶
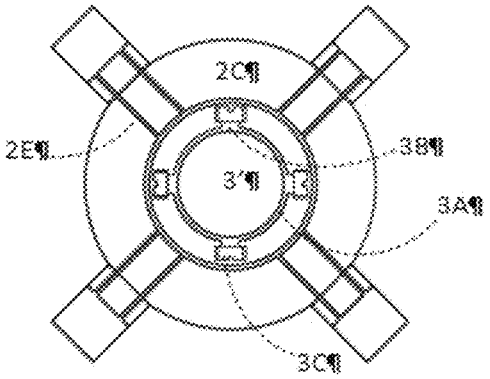
Figure 2B¶
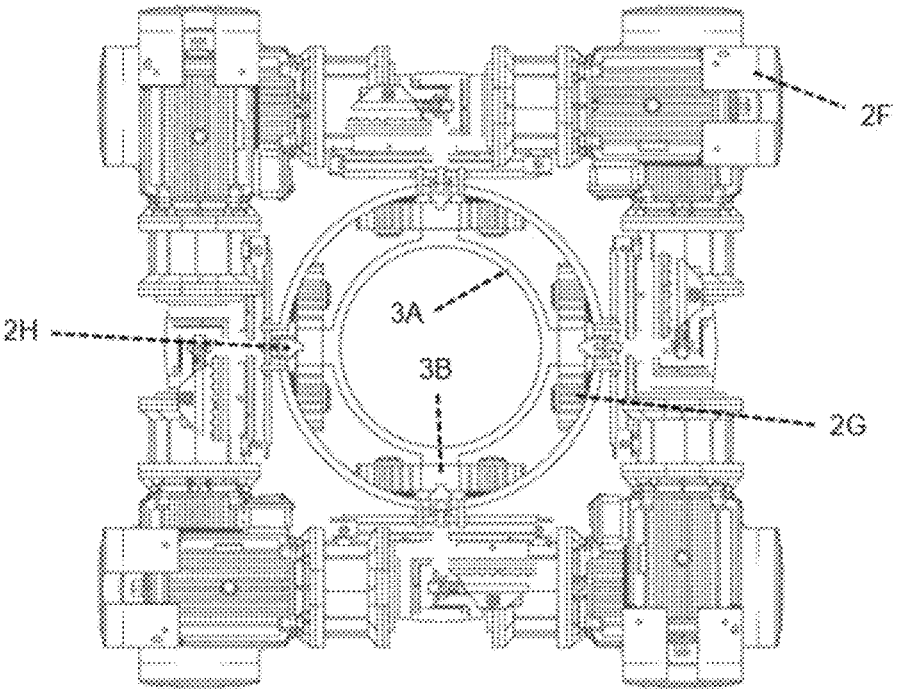
Figure 2C¶

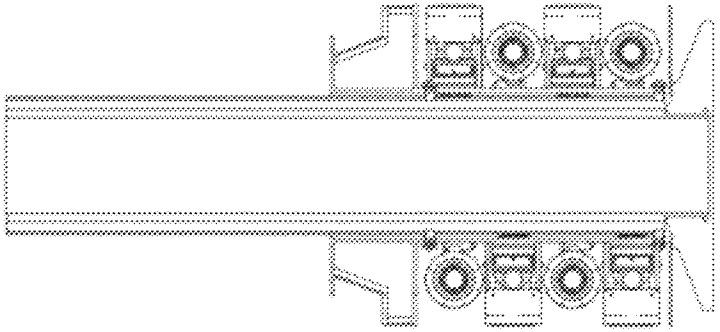
Figure 4¶

JACK FOR DRILLING

CROSS-REFERENCE TO RELATED APPLICATIONS

This application is a 371 of PCT/NO2023/060007 filed on Jun. 30, 2023, published on Jan. 11, 2024 under publication number WO 2024/010457 A1, which claims priority benefits from Norwegian patent application No. 20220782 filed Jul. 7, 2022, each of which are incorporated herein in their entirety by reference.

TECHNICAL FIELD

The present invention concerns a jack for drilling, such as utilized during hydrocarbon production and exploration. Specifically, the present invention concerns an electrically or hydraulically driven jack.

BACKGROUND

Bottom hole assembly's (BHA's) are used to drill into sediment or rock formations, for example during hydrocarbon exploration and production. BHA's include, amongst other components, a drill bit coupled to one or more pipe sections. The pipe sections are linked to form a drill string. The drill string connects the drill bit, located down hole, to the surface. During drilling of a bore hole, the drill string may rotate. Pipe sections are progressively attached to the drill string at the surface, as the drill bit below moves further into the sediment or rock formation. Conversely, during removal of the drill string from the borehole, pipe sections are progressively removed from the drill string, at the surface end thereof. In order to handle the drill string a jack is normally provided, for receiving, clamping, pushing and/or pulling pipe sections. The jack may additionally allow rotational movement of the drill string. The jack clamps the last pipe section of the drill string, at the surface end thereof, and exerts an axial force on the pipe section, to lower or raise the pipe section, and thereby the entire drill string, in a controlled manner. As the bore hole may be under pressure, the jack may be configured to impart sufficient axial force to overcome bore hole pressure.

A jack usually includes one or more hydraulic cylinders, or pistons, connecting a stationary base and a moveable top plate. The hydraulic cylinders limit the range of travel of the top plate between a retracted position, having minimal distance to the base, and an extended position, having maximal distance to the base. The base and the top plate include apertures for receiving a pipe section. The jack also includes at least one clamping tool, for clamping the pipe section, such as a slip bowl assembly. In operation during drilling, the pipe section that forms the surface end of the drill string extends through the apertures in the base and the top plate and is clamped by the clamping tool(s). The hydraulic cylinders are in the extended state. The clamped pipe section is then lowered towards, or into, the bore hole, by contracting the hydraulic cylinders and thereby exerting axial force on the pipe section. Depending on the axial length of the pipe section and the range of vertical travel of the jack, the steps of extension and contraction of the jack may have to be repeated several times for one single pipe section. The operation may then be repeated, in order to link a further pipe section to the drill string, thereby extending the drill string section by section. When the drill string is to be removed from the bore hole, the operation is reversed.

During drilling, the drill string may rotate, in order to provide rotation to the drill bit. Consequently, torque is exerted by the pipe section that is clamped by the jack, on the jack itself. A disadvantage with hydraulic jacks is that the torque exerted by the drill string limits the amount of travel of the hydraulic cylinders. If the hydraulic cylinders extend too much, they cannot withstand the torque applied by the rotating drill string and consequently, mechanical failure of the jack may occur. This limitation on the range of travel between the extended position and the retracted position leads to an inefficient and time-consuming operation.

Consequently, there is a clear need for an improved jack for drilling with a bottom hole assembly during hydrocarbon exploration and production, which avoids the aforementioned issues and can withstand the torque exerted by a rotating drill string, even when having a large range of vertical travel.

SUMMARY OF THE INVENTION

The present invention concerns a jack for drilling, the jack comprising: an elongated receiving element for receiving and clamping a tubular element, and a base comprising an open-ended aperture. The elongated receiving element is arranged in the open-ended aperture. The elongated receiving element is linearly moveable through the open-ended aperture between a retracted position and an extended position. The present invention also concerns a drill rig comprising at least one jack according to the invention. The present invention also concerns a method for handling a tubular element, comprising providing a jack according to the invention, clamping a tubular element in the elongated receiving element of the jack and lowering the tubular element by lowering the elongated receiving element, or raising the tubular element by raising the elongated receiving element.

FIGURES

FIG. 1A schematically shows a side view of a jack according to the present invention in retracted position.

Figure 1B:
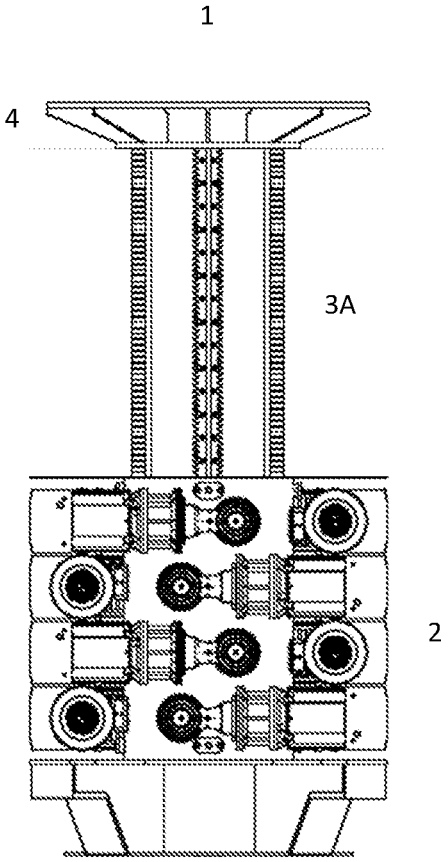

FIG. 1B schematically shows a side view of a jack according to the present invention in extended position.

FIG. 2A schematically shows a base of a jack according to the present invention.

FIG. 2B schematically shows a bottom view of a jack according to the present invention.

FIG. 2C shows a transversal cross-section of a jack according to the present invention.

Figure 3A:
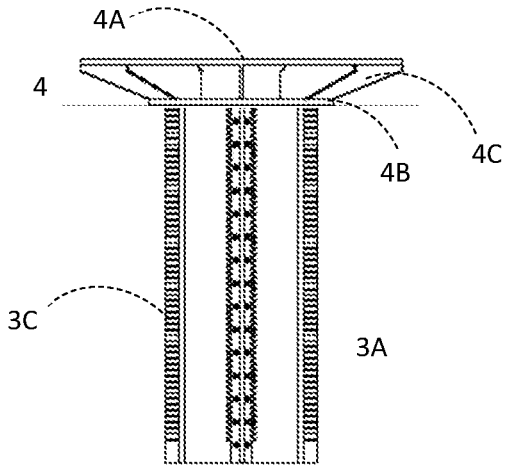

FIG. 3A schematically shows an elongated receiving element of a jack according to the present invention.

Figure 3B:
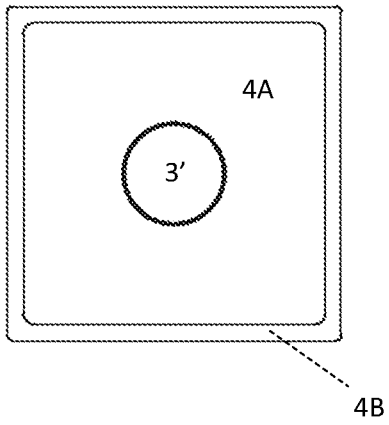

FIG. 3B schematically shows a top view of a jack according to the present invention.

FIG. 4 schematically shows a longitudinal cross-section of a jack according to the present invention.

DETAILED DESCRIPTION

Hereinafter, exemplary embodiments of the present invention are described in detail with reference to FIGS. 1-4. Like components are denoted by like reference numerals throughout the description and figures.

FIGS. 1A and 1B schematically show a side-view of a jack 1 for drilling, such as drilling with a bottom hole assembly, according to the invention. The jack 1 includes a base 2 and an elongated receiving element 3A. The base includes an open-ended aperture. The elongated receiving element 3A is linearly moveable through the aperture between a retracted position (shown in FIG. 1A) and an extended position (shown in FIG. 1B). The lengthwise axis of the elongated receiving element 3A is aligned with the lengthwise axis of the aperture in the base 2. The elongated receiving element 3A includes an open-ended axial aperture in which a tubular element, such as a pipe section of a drill string, a rod, or the like, can be received and clamped. The elongated receiving element 3A may further include an end plate 4. In the retracted position the end plate 4 is at a minimum distance to the base 2. Preferably, the end plate 4 rests on the base 2 in the retracted position. In the extended position the end plate 4 is at a maximum distance from the base 2. The base 2 is configured to drive the linear motion of the elongated receiving element 3A, between the retracted position and the extended position.

The base 2, shown in isolation in side view FIG. 2A and in bottom view in FIG. 2B, includes a main body 2A. The main body 2A includes the open-ended aperture. Preferably, the main body 2A is centered around the open-ended aperture. The main body 2A may be a pipe segment, or any other elongated element with a central open-ended aperture. The base 2 may include a top plate 2B and a bottom plate 2C. The main body 2A extends from the top plate 2B to the bottom plate 2C. The top plate 2B and bottom plate 2C extend outward from the main body 2A. Preferably, the top plate 2B and bottom plate 2C are parallel to one another. The base 2 may also include a support plate 2D, placed between the top plate 2B and the bottom plate 2C. The support plate 2D extends outward from the main body 2A. The support plate 2D may extend parallel to the bottom plate 2C. One or more reinforcing elements 2E may connect the support plate 2D with the bottom plate 2C. The one or more reinforcing elements 2E are placed radially around the outer periphery of the main body 2A. The base 2 may include a steel material, preferably stainless steel. The base 2A may be connected to the top plate 2B, the bottom plate 2C, the support plate 2D and the reinforcing elements 2E by a welded connection and/or a bolt connection.

With further reference to FIG. 2A, the jack 1 further includes one or more motors 2F for driving linear motion of the elongated receiving element 3A. The one or more motors 2F are mounted on the main body 2A. Preferably, the one or more motors 2F are mounted on an external surface of the main body 2A. The one or more motors 2F are placed between the support plate 2D and the top plate 2B. Preferably, each motor 2F extends perpendicular to the axial direction of the base 2, and parallel to the top plate 2B and to the bottom plate 2C. Furthermore, the one or more motors 2F are preferably arranged in a staggered configuration, where axially adjacent motors 2G, located on one side of the main body 2A, extend into opposite directions. Thereby adjacent motors 2g can be arranged with a closer axial spacing, achieving a compact configuration and saving space. The jack may thus fit into standard drill rig configurations and replace a regular hydraulic cylinder jack, without complex and expensive rig adaptations. The one or more motors 2F may be electrical motors and/or hydraulic motors. The motor 2F may, for instance be a brushless DC motor. The one or more motors 2F are powered by a suitable power source (not shown).

As shown in the transversal cross-section in FIG. 2C, the base 2 further includes one or more gear wheels 2G. The one or more gear wheels 2G are mounted in the open-ended aperture of the main body 2A. Each gear wheel 2G is configured to engage a corresponding linear gear (detailed below) of the elongated receiving element 3A. For each linear gear, at least one gear wheel 2G, preferably at least two gear wheels 2G, more preferably at least three gear wheels 2G, are provided. The gear wheels 2G engaging one linear gear are aligned along the axial direction of the main body 2A. Thereby, a linear motion of the elongated receiving element 3A within, and aligned with, the open-ended aperture is achieved. One motor 2F may be coupled to one gear wheel 2G, to drive rotation of the gear wheel 2G. Alternatively, one motor 2F may be coupled to multiple gear wheels 2G. The motor 2F is coupled to the gear wheel 2G by a shaft (not shown), extending through the main body 2A.

The base further includes at least one brake element 2H, FIG. 2A. Preferably, at least one, more preferably at least two, brake elements 2H are provided for each gear flange (detailed below) of the elongated receiving element 3A. When two brake elements 2H are provided for each gear flange, the two brake elements 2H are preferably spaced apart and aligned along the axial direction of the axial aperture of the main body (see FIG. 2A). For each brake element 2H the base 2 is further provided with an actuator, driving a linear movement of the brake element 2H from a retracted position to an engaged position. In the engaged position the brake element 2H may engage the elongated receiving element in order to exert a friction force thereon. Preferably, the brake element engages a gear flange of the elongated receiving element. The at least one brake element 2H is arranged in the axial aperture of the main body 2A. The at least one brake element 2H may include a metal material, such as bronze. Advantageously, the linear movement of the elongated receiving element may be slowed, or stopped, by the action of the at least one brake element.

Figure 3C:
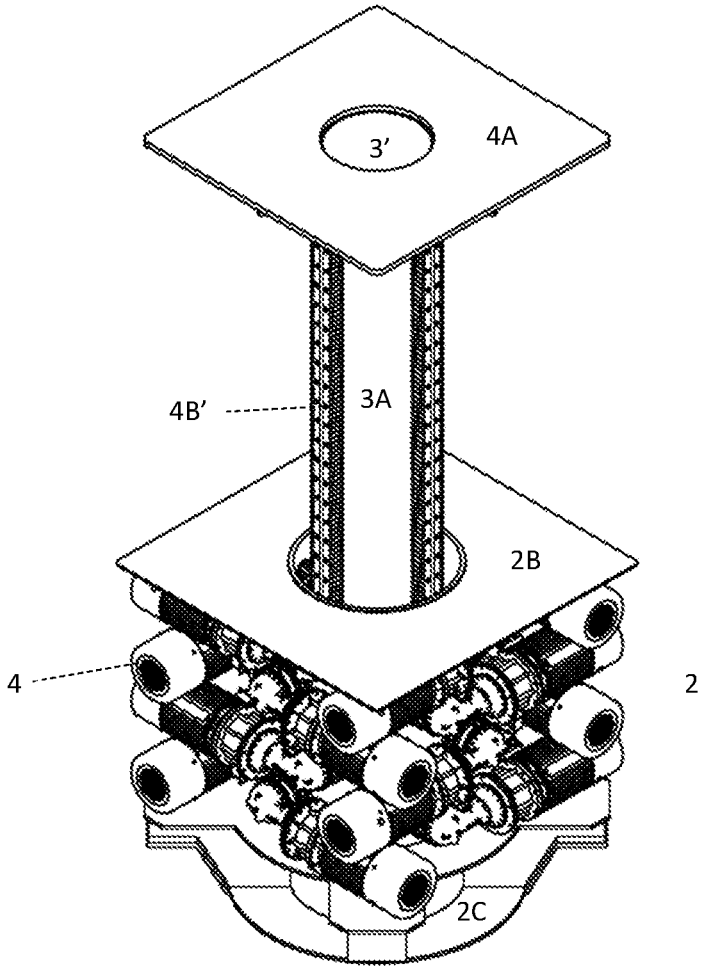

The elongated receiving element 3A, shown in isolation in FIG. 3A, and in perspective view in FIG. 3C, includes an open-ended aperture 3', for receiving a tubular element, such as a pipe section of a drill string, a rod, or the like. The end plate 4, schematically shown from above in FIG. 3B, extends outward from the circumference of one open end the aperture 3'. When the elongated receiving element 3A is in the retracted position (FIG. 1A), the end plate 4 preferably rests on the base 2. When the elongated receiving element 3A is in the extended position (FIG. 1A), the end plate 4 is at a maximum distance from the base 2. The elongated receiving element 3A is linearly moveable, from the retracted position to the extended position. Thereby, the jack 1 can lower or raise a tubular element, clamped in the elongated receiving element 3A.

The end plate 4 may include a cover 4A, extending around the upper open end of the elongated receiving element 3A. The end plate 4 may further include a support 4B, extending parallel to the cover 4A, and placed at a distance therefrom along the elongated receiving element 3A. The end plate 4 may further include one or more reinforcing elements 4C, extending from the cover 4A to the support 4B. The one or more reinforcing elements 4C extend radially outward from the pipe segment 3A. The elongated receiving element 3A may include a steel material, preferably stainless steel. The elongated receiving element 3A may be connected to the support 4B, the cover 4A, and the reinforcing elements 4C by a welded connection and/or a bolt connection.

The elongated receiving element 3A is provided with at least one clamping tool (not shown), to clamp or grip a tubular element, such as a pipe section of a drill string. Combining the clamping force, exerted by the clamping tool, with the axial force due to the linear motion of the elongated receiving element 3, the jack can exert force on the pipe section in the axial direction and achieve a controlled raising or lowering of the pipe section and the attached drill string. The clamping tool may preferably include a wedge tool.

At least two, preferably at least three, more preferably at least four, gear flanges 3B, are arranged on an external surface of the elongated receiving element 3A, schematically shown in FIGS. 2B, 3A and 3C. Each gear flange 3B extends radially outward from the elongated receiving element 3A, parallel to the axial direction of the elongated receiving element 3A. The gear flanges 3B are preferably arranged equidistantly around the circumference of the pipe segment 3A. The number of gear flanges can be increased or decreased, depending on the maximum torque that is exerted on the jack by the rotating drill string. Advantageously, the jack can thereby withstand torque exerted by the rotating drill string, even when extending over a large range of travel. Thereby less lifting or lowering steps are needed per pipe section providing a more economical operation. Preferably, each gear flange 3B is positioned such that it can be engaged by one or more aligned brake elements 2H. Preferably, a pair of linear gears 3C are arranged on each gear flange 3B. The pair of linear gears 3C are arranged on opposite sides of the gear flange 3B and face away from one another.

Each linear gear 3C is engaged by at least one gear wheel 2G. Preferably, each linear gear 3C is engaged by at least two, more preferably at least three, gear wheels 2G. Advantageously, by increasing or decreasing the number of gear wheels and corresponding motors for each linear gear, the amount of axial force that the jack can exert on a clamped pipe section can be precisely tuned. Gear wheels 2G engaging the same linear gear 3C are distanced along the axial direction of the main body 2A. Preferably, the gear wheels 2G engaging the opposite linear gears 3C of the same flange 3B, are arranged in an axially staggered manner. Thereby, axially adjacent gear wheels 2G engage opposite linear gears 3C. Furthermore, the motors 2F associated to axially adjacent gear wheels 2G preferably extend outward from the gear wheels 2G, into opposite directions. Thereby, the adjacent gear wheels and motors can be spaced more closely in the axial direction and a compact form is achieved.

In the embodiment of FIGS. 1-4, the elongated receiving element 3A includes four flanges 3B. Each flange 3B is provided with two linear gears 3C, where one linear gear 3C is provided on each side of the flange 3B. Thereby, the elongated receiving element 3A includes eight linear gears 3C in total. The base 2 is provided with sixteen gear wheels 2G, where two gear wheels 2G are provided for each linear gear 3C. Each gear wheel 2G is driven by a motor 2F. The gear wheels 2G and motors 2F associated to one flange 3B are staggered in the axial direction of the main body 2A. The motors 2F associated to one linear gear 3C of a gear flange 3B extend outward from the main body 2A in one direction and the motors 2F associated to the other linear gear 3C on the same gear flange 3B extend in the opposite direction, in a staggered pattern. Thereby motors 2F associated to a linear gear 3C of one flange 3B can extend into the gaps formed between the motors 2F associated to one linear gear 3C of an adjacent flange 3B, as shown in FIGS. 1A, 1B, 2A, 3C and 4. Advantageously, a compact configuration is thereby achieved. The number of gear wheels and motors can be decreased or increased along the axial direction, depending on the maximum axial force that is exerted on a clamped pipe section.

In operation, the one or more motors 2F rotate the gear wheels 2G. The gear wheels 2G drive the one or more linear gears 3C. Thereby, the elongated receiving element 3A is moved linearly between the extended position and the retracted position. By reversing the direction of the motors 2F, the direction of linear motion of the elongated receiving element 3A is reversed. Advantageously, the present configuration with a base and receiving element is able to withstand the torque exerted by a rotating drill string.

The invention further concerns a drill rig, such as a drilling rig for hydrocarbon exploration and production, including at least one jack according to the invention. The drill rig may be an offshore drill platform, an onshore drill installation, or a vessel-mounted drill installation. Advantageously, the jack according to the invention fits to a standard drill rig and no complicated and expensive reconfigurations of the drill rig need to be performed.

The invention also concerns a method for handling a pipe section, such as a pipe section of a bottom hole assembly. The method includes providing a jack 1 according to the present invention and clamping the pipe section in the elongated receiving element 3A of the jack 1. The pipe section is lowered into a bore hole or raised from a bore hole. The pipe section is coupled to a drill string before being lowered into the bore hole or decoupled from the drill string before being raised from the bore hole. Finally, the drill string and the pipe section may be rotated during clamping. Advantageously, the clamped pipe section can be lowered or raised over a large range of travel, whereas the jack withstands the torque exerted by the rotating pipe section.

LIST OF REFERENCES

1 jack
2 base
2A main body
2B top plate
2C bottom plate
2D support plate
2E reinforcing element
2F motor
2G gear wheel
2H brake element
3A elongated receiving element
3B gear flange
3C linear gear
3' axial aperture
4 end plate
4A cover
4B support
4C reinforcing element

The invention claimed is:

1. A jack for drilling, the jack comprising:

an elongated receiving element for receiving and clamping a tubular element; and a base including an open-ended aperture, the elongated receiving element being arranged in the open-ended aperture;

wherein the elongated receiving element is linearly moveable through the open-ended aperture between a retracted position and an extended position;

the base includes one or more gear wheels mounted in the open-ended aperture;

the elongated receiving element includes two linear gears arranged on an external surface of the elongated receiving element along the axial direction thereof, and one or more gear flanges extending radially outward along the axial direction of the elongated receiving element, wherein the two linear gears are arranged on opposite sides of each of the one or more gear flanges, the two linear gears facing away from one another; and each linear gear is engaged by at least one gear wheel.

2. The jack of claim 1, wherein the base comprises at least one motor for driving the linear motion of the elongated receiving element.

3. The jack of claim 2, wherein the at least one motor is an electric motor or a hydraulic motor.

4. The jack of claim 2, wherein the at least one motor drives at least one gear wheel.

5. The jack of claim 2, wherein the base comprises a main body, the main body including the open-ended aperture, and wherein the at least one motor includes a plurality of motors arranged in a staggered configuration, where axially adjacent motors located on one side of the main body extend into opposite directions.

6. The jack of claim 1, wherein each linear gear is engaged by at least two gear wheels.

7. The jack of claim 1, wherein at least two gear flanges are arranged on an external surface of the elongated receiving element.

8. The jack of claim 1, wherein the at least one gear wheel includes a plurality of gear wheels, where one of the plurality of gear wheels is associated with one of the one or more gear flanges and staggered in the axial direction, such that the one of the plurality of gear wheels engages one of the two linear gears and an axially adjacent gear wheel of the plurality of gear wheels engages the opposite linear gear.

9. The jack of claim 1, further comprising at least one brake element arranged to engage a gear flange.

10. The jack of claim 9, wherein the at least one brake element comprises a metal material.

11. The jack of claim 1, wherein the elongated receiving element comprises an end plate, and wherein the end plate is at a minimum distance to the base in the retracted position and at a maximum distance from the base in the extended position.

12. A drill rig comprising at least one jack according to claim 1.

13. A method for handling a tubular element, the method comprising:

providing a jack according to claim 1;

clamping a tubular element in the elongated receiving element of the jack; and lowering the tubular element by lowering the elongated receiving element, or raising the tubular element by raising the elongated receiving element.

14. The method of claim 13, wherein the tubular element is a pipe section of a drill string and wherein the pipe section is rotated during clamping.

15. The jack of claim 10, wherein the metal material comprises bronze.

* * * * *